US008651507B2

(12) United States Patent
Kylstra et al.

(10) Patent No.: US 8,651,507 B2
(45) Date of Patent: Feb. 18, 2014

(54) MOUNTING ASSEMBLY FOR ATTACHING AUXILIARY EQUIPMENT TO A WHEELCHAIR

(75) Inventors: Bart Kylstra, San Francisco, CA (US); Nathan Isaiah Jauvtis, San Francisco, CA (US); Thomas Martin Cook, San Francisco, CA (US); Sean Kerrel, Oakland, CA (US)

(73) Assignee: Daedalus Wings, Inc., San Francisco, CA (US)

( * ) Notice: Subject to any disclaimer, the term of this patent is extended or adjusted under 35 U.S.C. 154(b) by 651 days.

(21) Appl. No.: 12/215,507

(22) Filed: Jun. 27, 2008

(65) Prior Publication Data

US 2009/0008902 A1 Jan. 8, 2009

Related U.S. Application Data

(60) Provisional application No. 60/937,333, filed on Jun. 27, 2007.

(51) Int. Cl.
*A61G 5/10* (2006.01)

(52) U.S. Cl.
CPC ..... *A61G 5/10* (2013.01)
USPC ..... 280/304.1; 280/250.1

(58) Field of Classification Search
USPC ..... 280/250.1, 304.1, 304.5, 647, 33.992; 180/13, 65.1; 248/118, 181.1, 288.11, 248/288.31, 288.51
See application file for complete search history.

(56) References Cited

U.S. PATENT DOCUMENTS

| | | | | | |
|---|---|---|---|---|---|
| 2,403,654 | A | * | 7/1946 | Gerdes | 248/118 |
| 2,649,309 | A | * | 8/1953 | Deissner | 280/42 |
| 3,485,510 | A | * | 12/1969 | Merlan | 280/250 |
| 3,999,778 | A | * | 12/1976 | Markiel | 280/304.1 |
| 4,005,840 | A | * | 2/1977 | Ratkovich | 248/118 |
| 4,316,616 | A | * | 2/1982 | Boivin | 280/304.1 |
| 4,320,884 | A | * | 3/1982 | Leo | 248/276.1 |
| 4,606,522 | A | * | 8/1986 | Heifetz | 248/276.1 |

(Continued)

FOREIGN PATENT DOCUMENTS

| | | | |
|---|---|---|---|
| DE | 4107410 | A1 | 9/1991 |
| GB | WO2004/018776 | A1 | 3/2004 |

OTHER PUBLICATIONS

Website printout: "MTC Freedom Wheel—User's Manual," Spokes n' Motion, Toulouse France, 15 pages.

*Primary Examiner* — Anne Marie Boehler
*Assistant Examiner* — Maurice Williams
(74) *Attorney, Agent, or Firm* — Law Offices of Thomas Schneck

(57) ABSTRACT

A mounting assembly for attaching auxiliary equipment to a wheelchair includes multiple adjustment features. In the preferred embodiment, different wheelchair widths may be accommodated by utilizing attachment arms that pivot coaxially with a main column of the auxiliary equipment. The mounting assembly preferably includes a pair of arms and a pair of links that extend from the arms. The lengths of the links and the arms may be adjusted by rotation of a rod portion of each arm and each link, but other means for enabling changes in length are possible. The links are preferably pivotally connected to the arms, so that the distance between the ends can be varied on the basis of the particular wheelchair. Ball-and-socket joints are used, but rotatability of the sockets permits flexibility of the orientations of the joints. Additionally, a vernier adjustment effect may be included to permit adjustments in the angle of the main column.

19 Claims, 6 Drawing Sheets

(56) References Cited

U.S. PATENT DOCUMENTS

| | | | | | |
|---|---|---|---|---|---|
| 4,759,564 | A | | 7/1988 | Williams, Jr. | |
| 4,887,826 | A | * | 12/1989 | Kantner | 280/250.1 |
| 5,016,720 | A | * | 5/1991 | Coker | 180/13 |
| 5,221,100 | A | | 6/1993 | McNutt | |
| 5,228,737 | A | * | 7/1993 | Zimmerman | 296/76 |
| 5,494,126 | A | * | 2/1996 | Meeker | 180/13 |
| 5,501,480 | A | * | 3/1996 | Ordelman et al. | 280/304.1 |
| 5,513,784 | A | * | 5/1996 | Pretorius | 224/584 |
| 5,651,558 | A | * | 7/1997 | Boyce | 280/304.1 |
| 5,711,542 | A | | 1/1998 | Kendall | |
| 5,899,476 | A | * | 5/1999 | Noyola | 280/250.1 |
| 6,149,178 | A | * | 11/2000 | Bradbury et al. | 280/293 |
| 6,244,366 | B1 | * | 6/2001 | Otterson et al. | 180/11 |
| 6,302,429 | B1 | * | 10/2001 | Friedrich | 280/649 |
| 6,347,776 | B1 | * | 2/2002 | Chuang | 248/288.51 |
| 6,669,222 | B1 | * | 12/2003 | Barrett et al. | 280/304.1 |
| 7,216,728 | B2 | * | 5/2007 | Huang et al. | 180/13 |
| 7,219,754 | B2 | * | 5/2007 | Johnson | 180/19.2 |
| 7,316,282 | B2 | * | 1/2008 | Mulhern et al. | 180/65.1 |
| 7,398,842 | B2 | * | 7/2008 | Fontecchio et al. | 180/6.5 |
| 7,425,010 | B2 | * | 9/2008 | Harris | 280/304.1 |
| 2003/0000748 | A1 | * | 1/2003 | McHardy et al. | 180/13 |
| 2003/0079923 | A1 | * | 5/2003 | Johnson | 180/19.3 |
| 2003/0196841 | A1 | * | 10/2003 | Mattson et al. | 180/65.1 |
| 2003/0218312 | A1 | * | 11/2003 | Forshee et al. | 280/304.1 |
| 2007/0096427 | A1 | * | 5/2007 | Knaub | 280/304.1 |
| 2008/0115982 | A1 | * | 5/2008 | Lin | 180/13 |

* cited by examiner

MOUNTING ASSEMBLY FOR ATTACHING AUXILIARY EQUIPMENT TO A WHEELCHAIR

CROSS REFERENCE TO RELATED APPLICATION

This application claims priority from co-pending provisional application No. 60/937,333, filed Jun. 27, 2007.

TECHNICAL FIELD

The invention relates generally to auxiliary equipment for attachment to a wheelchair and more particularly to mounting assemblies for wheelchair auxiliary equipment such as hand cycles, towing devices and powering equipment.

BACKGROUND ART

The number of people who depend upon a wheelchair for mobility increases as medical science continues progress in the treatment of the elderly and the disabled. Currently available wheelchairs are lightweight and easily maneuvered, allowing users to remain more active and to participate in more activities than would be possible without relatively recent advancements in wheelchair design. Additionally, the transportation of wheelchairs has been facilitated by constructing some models to collapse (fold) horizontally to the center of the wheelchair.

It is sometimes desirable to attach auxiliary equipment to a wheelchair. For example, a hand cycle may be attached for purposes of exercise or for purposes of providing an alternative to the traditional pushrim propulsion for driving the wheelchair. Motorized auxiliary equipment is another option. A third possibility for auxiliary equipment which is used in managing movement of the wheelchair is a towing device for linking the wheelchair to another vehicle or device, such as a towing device for connection to a bicycle to be driven by another person.

U.S. Pat. No. 4,483,548 to Zirrilo describes a wheelchair auxiliary drive assembly that includes a hand crank. The assembly may be mounted to a wheelchair using telescopically constructed rods. For many wheelchairs, a pair of relatively small front wheels extend from upright tubular frame members to support the forward portion of the wheelchair. The device described in Zirrilo utilizes these upright frame members for mounting the auxiliary equipment. Two telescoping assemblies extend horizontally between the two upright frame members. Each telescoping assembly includes a C-shaped clamp at each end. When the telescoping assemblies are locked at the appropriate length, the C-shaped clamps apply force to the two upright frame members of the wheelchair to fix the various components in position. Then, main posts extend outwardly from the center of the wheelchair to the equipment that includes the hand crank. While the mounting assembly of Zirrilo works well for its intended purpose, one concern is that the center mounting of the auxiliary equipment prevents any collapsible wheelchair from being folded without first removing the mounting assembly.

The traditional center mounting of auxiliary equipment to a wheelchair is also used for systems sold under the trademark "SPEEDY" by Bromakin Wheelchairs. While there are limitations on the configuration of the wheelchair frame to which the mounting assembly may be readily added, there is flexibility in the sophistication of the equipment being added by use of the mounting assembly. However, when the equipment is mounted to a wheelchair frame that is designed to collapse for easy transportation or storage, the auxiliary equipment prevents the chair from being collapsed unless removed.

Increased flexibility in mounting auxiliary equipment, such as a hand cycle, to a wheelchair is provided using the system of R&E Stricker GmbH. A mounting bar is connected to the steering column of the hand cycle, with a pair of attachment arms being pivotally connected at opposite ends of the mounting bar. The two pivotal connections permit adjustments on the basis of wheelchair width.

While significant advancements have been made in the area of increasing alternatives for persons confined to a wheelchair, further advancements are sought. A mounting assembly for attaching auxiliary equipment to a wheelchair should be easily adjusted to accommodate fit to a wide variety of wheelchair designs, should be lightweight, and should not require sacrifices of conveniences designed within the wheelchair to which the auxiliary equipment is mounted.

SUMMARY OF THE INVENTION

In accordance with the invention, a mounting assembly for attaching auxiliary equipment to a wheelchair includes multiple adjustment features that enable chair-to-chair adjustability and, in the preferred embodiment, user-to-user adjustability. The mounting assembly includes a main column. For example, the main column may be a steering column of a hand cycle or motor-powered device, but may merely be a towing column of auxiliary equipment that is to be connected to a bicycle or other vehicle, or even equipment unrelated to movement of the wheelchair, such as a desk or table.

In the preferred embodiment, a pair of arms and a pair of links are used to couple the main column to the frame of a wheelchair. A mechanical advantage may be achieved by connecting each arm to the main column so as to independently pivot about an axis that is co-axial with the main column. Each arm has a forward end that is pivotally connected for independent movement about the main column, so that the opposite end can be moved to accommodate attachment of the mounting assembly to any of a variety of wheelchairs of different widths and configurations. In at least one embodiment, the two links are connected to the two arms. Chair-to-chair adjustments are enabled by pivotally connecting a first link to one of the arms and pivotally connecting the second link to the other arm.

Each link and each arm may have an attachment end that is configured to be connected to the wheelchair frame at clamps. Preferably, each clamp includes a ball stud of a ball-and-socket joint. The attachment ends of the arms and links have a geometry to each provide the ball socket of such a joint, but are quickly locked or released to achieve a secure quick-release mechanism. These attachment ends may be rotatable relative to the wheelchair frame, so that the ball studs of the clamps may be connected at different angles to the vertical. The ball studs may have threaded regions which are operable in tightening the clamps to the wheelchair frame. For example, the ball studs may function as the nuts for providing the compression force in securing the clamps to the frame. For each clamp, ease of attachment and detachment to the wheelchair frame is provided by forming the clamp such that it is hinged at one end and configured to enable tightening using the ball stud at its opposite end (opposite sides of contact with a frame member of the wheelchair).

User-to-user adjustability may be incorporated by enabling adjustment of the angle of the main column to the vertical. In one embodiment, a first set of alignment holes is formed on the forward end of each arm. A hinge which permits the independent pivoting of the arms about the axis of the main column includes a pair of second sets of alignment holes. The center-to-center pitch of the first sets is different than the center-to-center pitch of the second sets. As a consequence, fine adjustments of the angle of the main column may be achieved by merely selecting the alignment hole of the first set and the alignment hole of the second set through which a fastening member is to pass. In effect, a vernier alignment effect is created. Another user-to-user adjustment permits changes in the height of the auxiliary equipment, such as by extending or retracting the main column.

Chair-to-chair adjustments are achieved by forming the arms and links to extend or retract. There are benefits if these lengthwise adjustments of arms and links are provided by forming the arms and legs to include threaded rods, as opposed to a potentially less secure tube-to-tube telescope.

One advantage of the mounting assembly in accordance with the invention is that the assembly may be connected to a folding wheelchair without sacrificing the collapsibility feature. The mounting assembly is permitted to simultaneously collapse, particularly for embodiments in which the arms pivot co-axially about the main column and ball-and-socket joints easily accommodate relative movement between the wheelchair and the individual components that connect to the wheelchair. Another advantage is that the ball-and-socket joints provide quick release mechanisms to free the wheelchair as desired. As an additional feature, even the clamps can be easily removed, where the clamps are fixed in place merely by the ball studs. In attaching auxiliary equipment to a wheelchair, adjustments may be made in the lengths of the arms and the links, as well as in the angles of the components to each other and the orientations of the individual ball-and-socket joints.

A centering spring may be attached to bias one of the arms so as to aid a user in steering auxiliary equipment. This feature may also be made adjustable.

DETAILED DESCRIPTION

Figure 1:
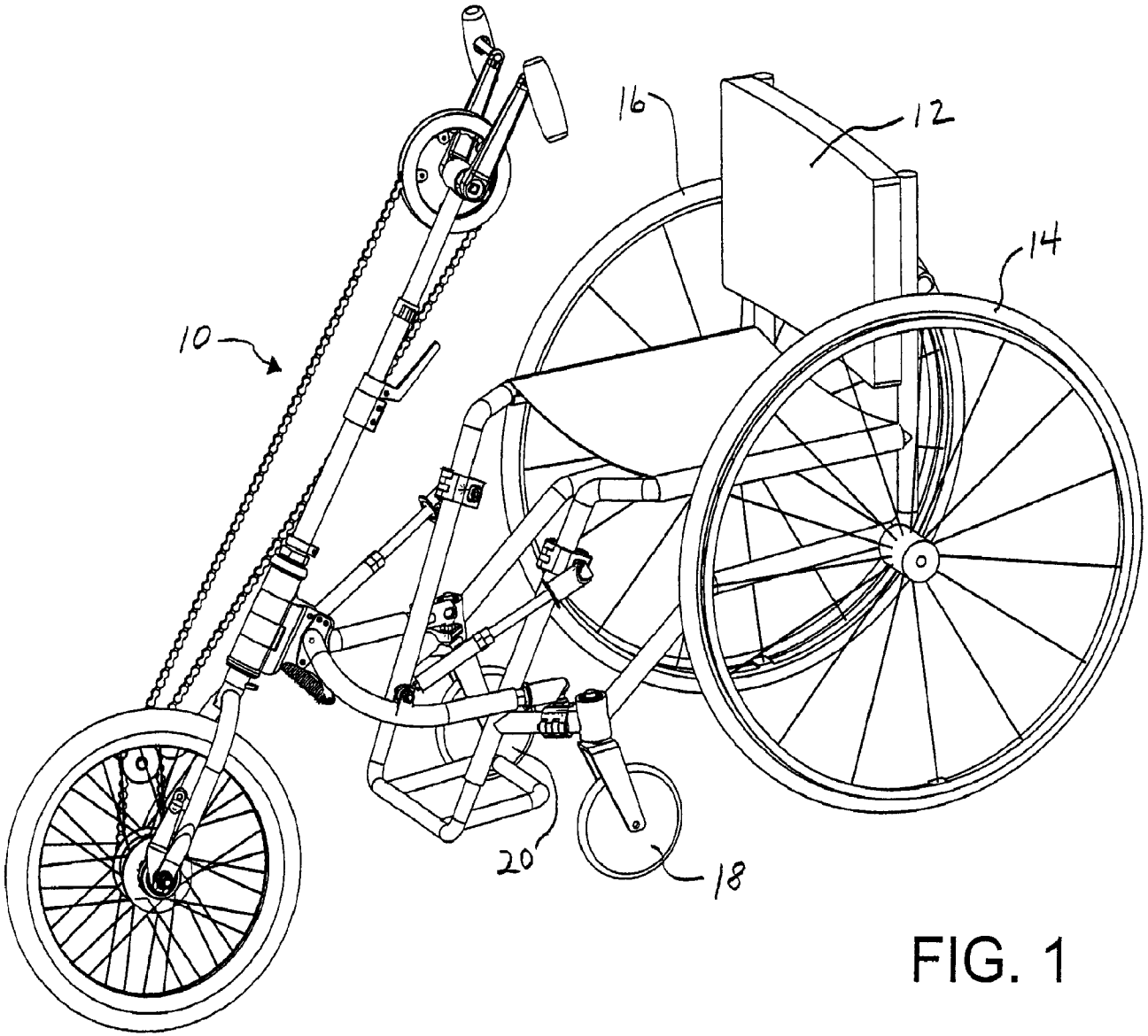
FIG. 1 is a perspective view of a wheelchair to which auxiliary equipment is attached using a mounting assembly in accordance with the present invention.

With reference to FIG. 1, a hand cycle 10 is shown as being connected to a frame of a wheelchair 12. A mounting assembly in accordance with the invention will be described with reference to the illustrated wheelchair and with reference to attachment of a hand cycle, but the mounting assembly is specifically designed to be connected to a wide variety of different wheelchairs and may be used for attaching other types of auxiliary equipment, including towing devices, desks and tables. The wheelchair includes a pair of main wheels 14 and 16 and a pair of front casters 18 and 20. The main wheels are adapted for pushrim propulsion, which is conventional in wheelchair design. However, with attachment of the hand cycle, the front casters are raised from ground level and the hand cycle equipment takes the place of the pushrims in driving the wheelchair.

Conventionally, the frames of wheelchairs are formed of connected tubular frame members. The tubular frame members are sturdy, but lightweight. There is no standard configuration. Instead, different manufacturers will design different geometries. In the geometry shown in FIG. 2, where the hand cycle 10 has been removed from the wheelchair 12, a pair of inclined frame members 22 and 24 decrease in distance from each other as they approach a footrest 26. Partially up from the footrest along each frame member 22 and 24 extend horizontal frame members 28 and 30. The four frame members 22, 24, 28 and 30 are used to mount the hand cycle 10 to the wheelchair having this particular design, despite the fundamentally different angles of the frame members.

Figure 2:
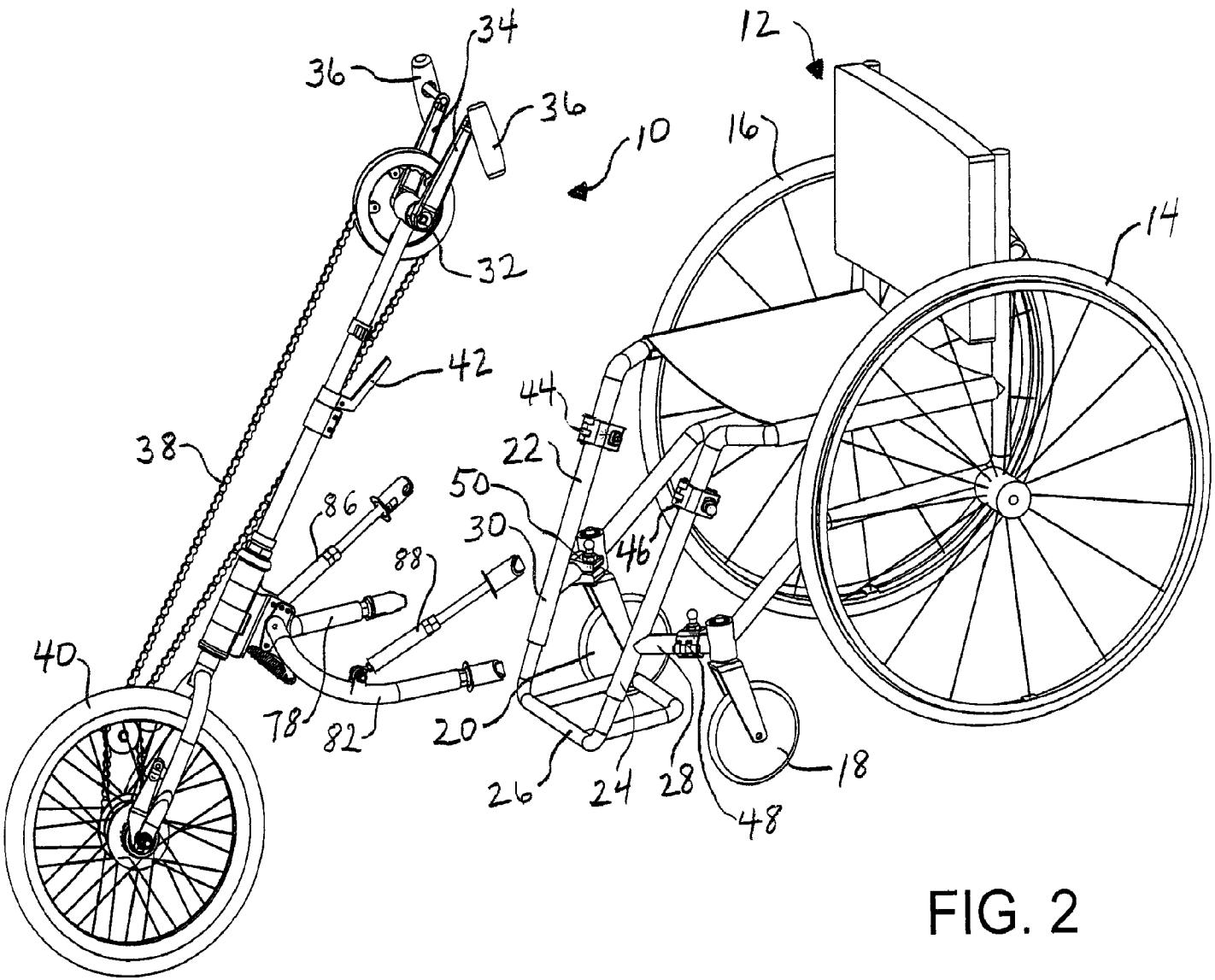
FIG. 2 is a perspective view of the auxiliary equipment of FIG. 1 removed from the wheelchair.
Figure 3:
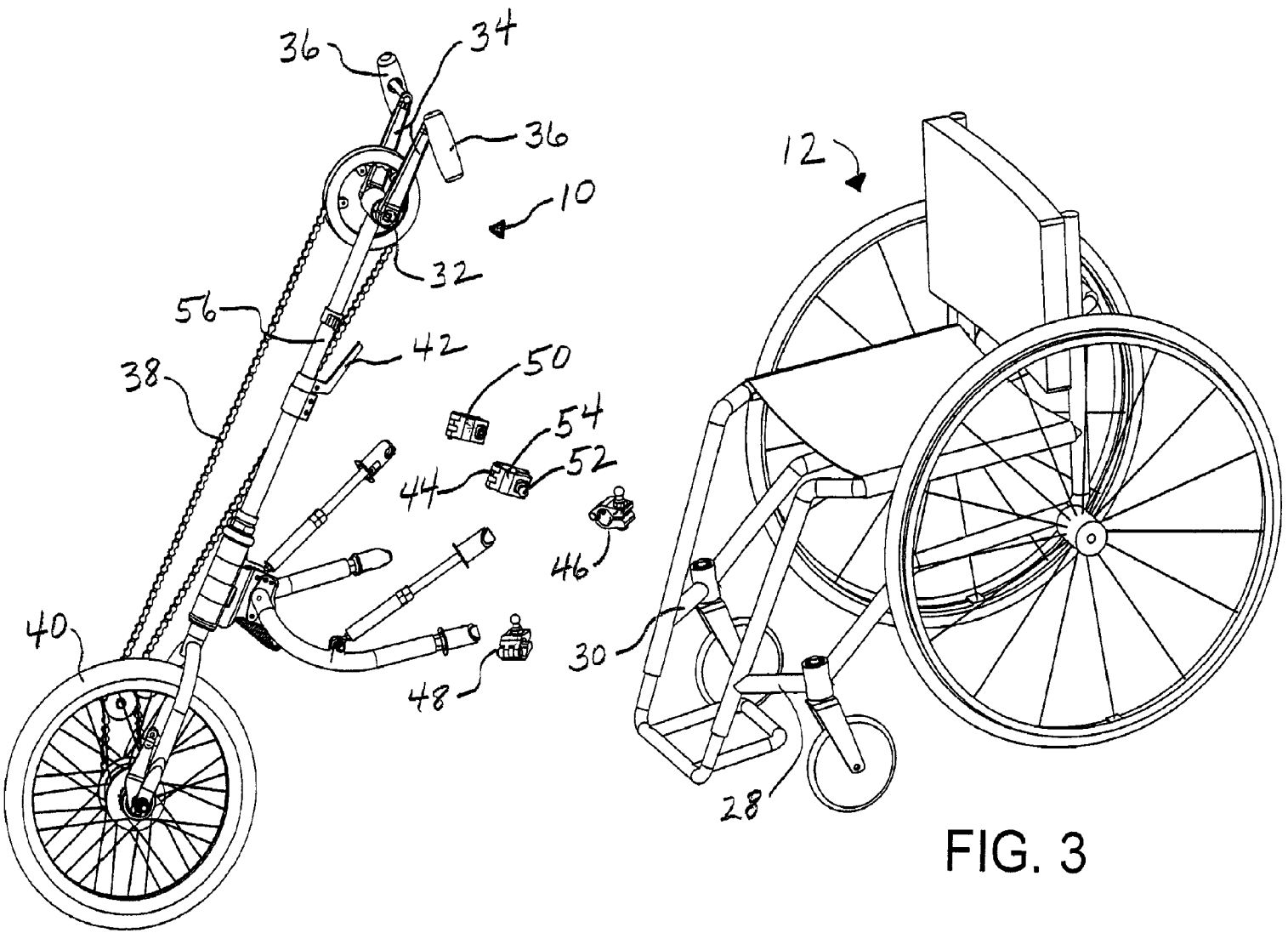
FIG. 3 is a perspective view of FIG. 2, but with mounting clamps removed from the wheelchair.

In FIGS. 1, 2 and 3, it can be seen that the hand cycle 10 includes a crank 32, a pair of crank arms 34, and a pair of hand pedals 36. In a conventional manner, a chain 38 is used in the transfer of motion of the crank 32 to rotation of a wheel 40. In the illustrated embodiment, the hand cycle 10 includes a multi-speed hub to which the wheel is mounted, but this feature is not significant to the invention. The embodiment also includes a "parking" brake 42.

The mounting assembly for attaching auxiliary equipment, such as the hand cycle 10, to the wheelchair 12 utilizes a number of clamps. In FIG. 2, four clamps 44, 46, 48 and 50 are shown as being fixed to the wheelchair, while FIG. 3 shows the clamps prior to attachment. The structure of an individual clamp will be described in detail below. Briefly, each clamp includes a ball stud 52 and a structure 54 that includes a curved internal surface which follows the contour of the frame members 22, 24, 28 and 30. For the convenience of the user of the wheelchair 12, the ball stud preferably faces outwardly from the center of the wheelchair. However, there may be embodiments in which the clamps are connected such that the ball studs face inwardly, particularly if legroom is not an issue.

Each ball stud 52 is configured to form one portion of a ball-and-socket joint. The direction of the ball stud is not significant because, as will be explained below, the socket portion of each joint may be rotated to its necessary orientation. In the preferred embodiment, the ball socket is used in the clamping action to the appropriate frame member 22, 24, 28 and 30. For example, a threaded bore (shown in FIG. 9) may be formed into the flattened underside of the ball stud. Then, tightening a nut into the threaded bore tightens the clamp in position. Preferably, the clamp is hinged at the end opposite to the location of the ball study (opposite side of the contact with the frame member), so that the clamps can be easily attached and detached.

As previously noted, the auxiliary equipment that is attached to the wheelchair 12 in accordance with the invention includes a main column. In FIG. 1, the main column of the hand cycle 10 is the steering column 56. Conventional adjustments of the steering column remain available for a user, but the mounting assembly enables significantly more adjustment features. The adjustment features will be described below, when referring to FIGS. 1, 4 and 5. As best seen in the exploded view of FIG. 5, a head tube 58 may be used to house conventional bicycle head tube bearings. An expanded headseat 60 is formed at the underside of the head tube.

As viewed in FIG. 5, a sleeve 62 resides below the head tube 58. One end of a centering spring 64 connects to an opening 66 within a fastening member 68 at the bottom of the sleeve. The function of the centering spring will be described below.

A right hinge plate 70 and a left hinge plate 72 are fitted together with alternating cylindrical portions and are then slid atop the head tube 58. As is the case with a conventional hinge, the hinge plates can be pivoted independently. Significantly, the pivot axis of the hinge is co-axial with the steering column of the hand cycle 10. In use, the components are held in position by a head set 74 and a clamp 76. The height of the steering column can be adjusted when the clamp 76 is not fully tightened. The significance of height adjustment will vary among the different applications of the mounting assembly. For example, if the present invention is used to mount a desk to a wheelchair, there is a significant convenience in allowing a user to change the height of the desktop.

Connected to the right hinge plate is the forward end of a first arm 78. In the illustrated embodiment, the forward end of the arm terminates in a flange 80. In like manner, a second arm 82 has a flange 84 at a forward end for connection to the left hinge plate 72.

Attached to each arm 78 and 82 is a link 86 and 88. The links are pivotally connected to the arms using spherical sockets 90 and 92 connected to brackets 94 along the lengths of the arms.

Adjustability features will now be described starting from the main column of the attached auxiliary equipment and progressing to the mechanical attachments to the frame members 22, 24, 28 and 30 of the wheelchair 12. The mounting assembly in accordance with the invention allows the angle of the main column to be adjusted using a vernier alignment effect. Similar to the height adjustment that was described above, this adjustability feature is based upon accommodating the preference of the user, as opposed to adjustability features that are available to accommodate different configurations and dimensions of wheelchairs. Referring particularly to FIG. 5, but also FIG. 4, each of the hinge plates 70 and 72 includes a first set of alignment holes 96. Five alignment holes are shown on each hinge plate, but the number is not critical. More alignment holes enable a greater number of alignment positions and, therefore, a greater flexibility in the angling of the main column to the vertical. Each flange 80 and 84 at the forward ends of the arms 78 and 82 includes a second set of alignment holes 98. Only two alignment holes 98 are shown, but preferably a greater number exist in order to increase the flexibility of angling the main column. The center-to-center pitch of the first sets of alignment holes 96 is different than the center-to-center pitch of the second set of alignment holes 98. That is, if a particular alignment hole 98 is aligned with a particular alignment hole 96, the two holes will be the only ones within the sets that are centered to each other. The two aligned holes are selected on a user-by-user basis. A matching selection is established for the other arm and fastening members, such as bolts, are passed through the selected aligned holes. A fastening member is also passed through lower holes 100 and 102 to secure the two arms to the two hinge plates. Because of their lower attachment holes, the two sets of upper alignment holes should include some curvature.

Figure 4:
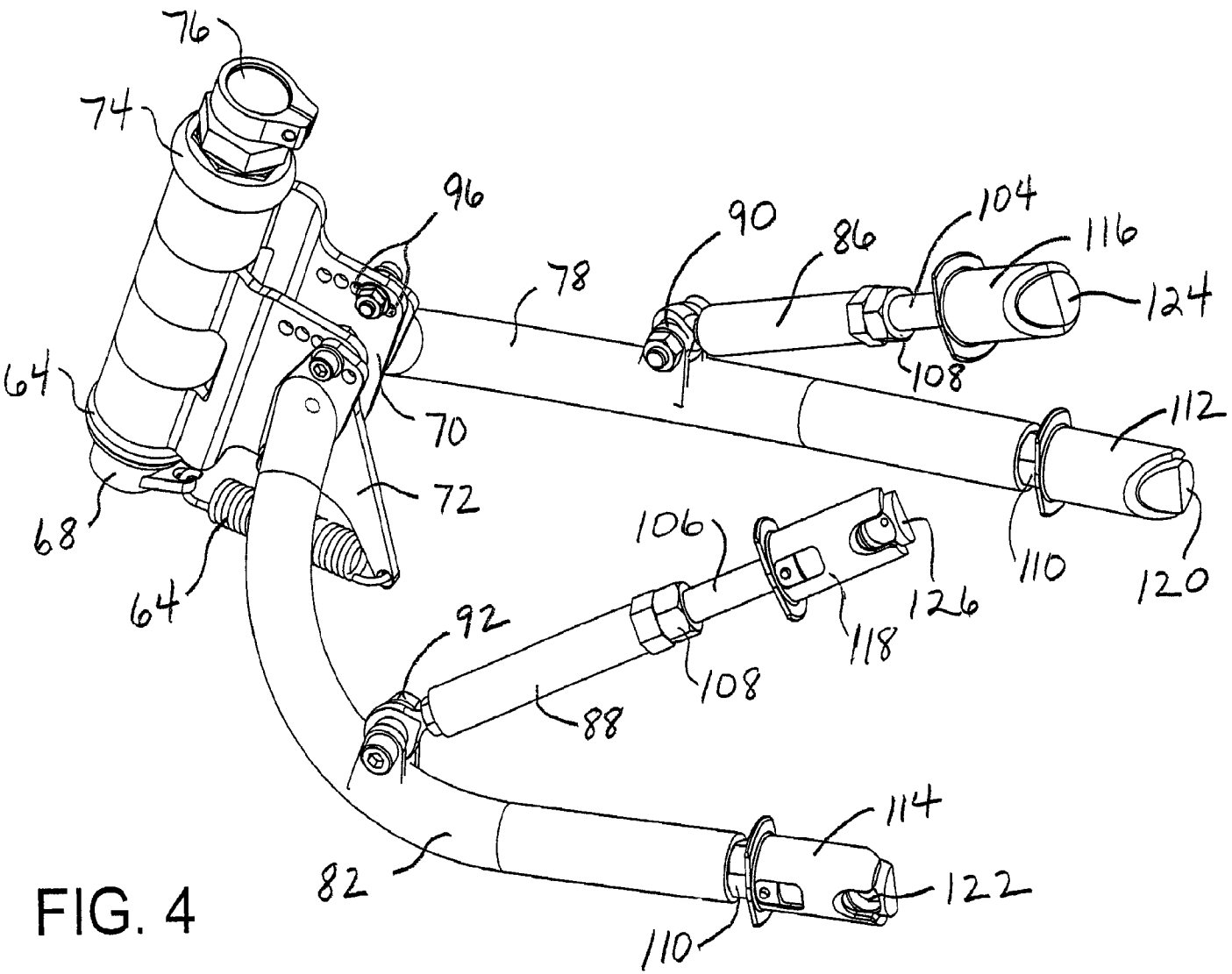
FIG. 4 is a perspective view of the mounting assembly of FIG. 3.
Figure 5:
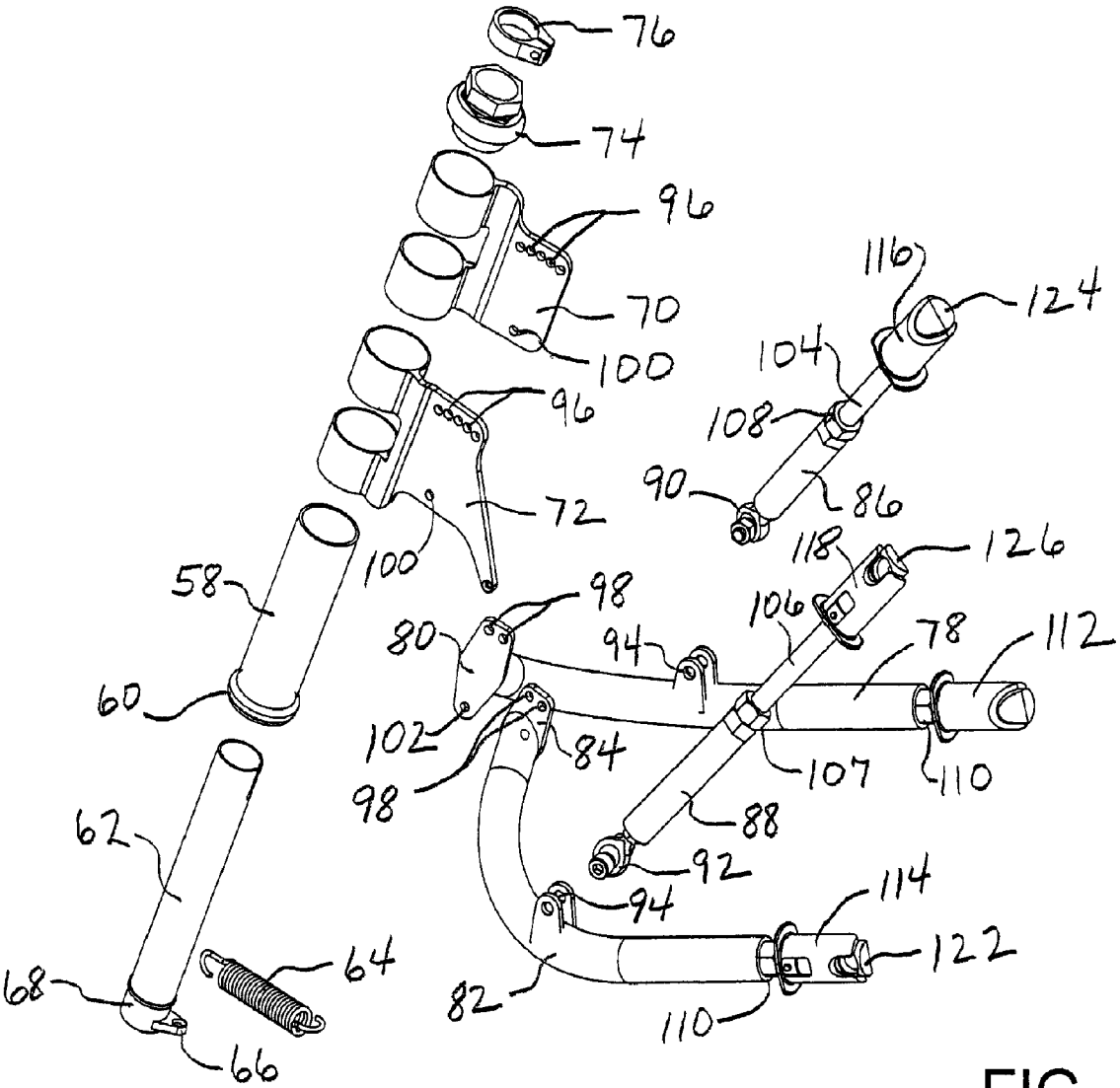
FIG. 5 is an exploded view of the mounting assembly of FIG. 4.

As best seen in FIG. 4, the centering spring 64 has one end attached to the opening 66 within the fastening member 68 at the bottom of the sleeve 62 (FIG. 5). The opposite end of the centering spring is connected to the left hinge 72. Therefore, the left arm 82 is biased toward a centering position, so that the hand cycle includes some bias to move in a linear direction in the absence of force applied by a user. The bias of the centering spring can be adjusted by rotating the sleeve before the sleeve is clamped in its desired position. This adjustability feature is another one that is determined on a user-by-user basis, rather than on the basis of the wheelchair 12.

Wheelchairs will vary significantly in width. Because the arms 78 and 82 of FIGS. 1-5 are hinged to the steering column 56 or other main column, the mounting assembly is able to accommodate different widths. The forward portions of the arms are "winged" (i.e., have a greater directional component away from the center), so that sufficient legroom is provided for a user. The opposite ends of the arms have a greater directional component in the rearward direction for attachment to the wheelchair 12. This arrangement is considered beneficial, but other arrangements have been contemplated.

In use, the distance between the rearward ends of the arms 78 and 82 will depend upon the attachment locations to the wheelchair 12. The pivot axis of the two arms is co-axial with the steering column 56 of the hand cycle. In addition to providing the adjustability feature on a chair-by-chair basis, another benefit of the this arrangement is that the mounting assembly is able to collapse when a collapsible wheelchair is folded. That is, unlike many prior mounting assemblies, the auxiliary equipment need not be detached when a user intends to fold the wheelchair for purposes of transportation or storage.

Another adjustability feature is provided by the connection of the links 86 and 88 to the arms 78 and 82. Each link is able to pivot relative to the arm to which it is attached. Therefore, the opposite ends of the links may be moved upwardly or downwardly while the corresponding ends of the arms remain locked in position. In the illustrated embodiment, the use of spherical sockets 90 and 92 at the brackets 94 also provides flexibility in a horizontal plane. This multi-dimensional flexibility may be used to accommodate connection to wheelchairs at various locations along the frame of the wheelchair.

A separate chair-to-chair adjustability feature is provided by allowing the links 86 and 88 and the arms 78 and 82 to be changed in length. As best seen on the links in FIGS. 4 and 5, threaded rods 104 and 106 comprise a portion of the links. Rotation of the rods relative to the opposite ends of the links will vary the length of the links. A jam nut 108 may be used to secure the rods in position once the desired length has been achieved. While not illustrated in FIGS. 4 and 5, the arms also include threaded rods that may be used to vary the length of the arms. Only the jam nuts 110 are visible.

As previously noted, the positions of the clamps 44, 46, 48 and 50 of FIG. 2, as well as their orientations, will vary on a chair-to-chair basis. The positions and orientations will depend upon the frame configuration of the wheelchair 12. Referring to FIG. 5, each arm 78 and 82 and each link 86 and 88 includes a collar 112, 114, 116 and 118. The collars may be retracted forwardly to fully expose ball sockets 120, 122, 124 and 126, as best seen with the collars of the left arm 82 and the left link 88. The collars are preferably spring loaded to enable quick release. That is, the collars remain within the position shown for collar 114 on arm 82, so as to expose the ball socket 122, until a ball stud of the corresponding clamp is brought into the proper position. The insertion of the ball stud within the ball socket automatically triggers release of the collar to lock the components.

The collars 112, 114, 116 and 118 and the ball sockets 120, 122, 124 and 126 rotate. The rotation may be as a consequence of the use of the threaded rods 104 and 106 or may be provided by a separate mechanism. Using the capability of the threaded rods to rotate the collars has little or no effect on the lengthwise adjustability feature, but provides a significant advantage in enabling adjustments with regard to angular orientation. It is possible to have all four ball sockets with different angular orientations.

When the mounting assembly is connected to a wheelchair, the arms 78 and 82 may be considered to form two sides of a triangle that is completed by the frame. Second and third triangles are formed by the relationship of the two links 86 and 88 to their corresponding arms. In most connections to the wheelchairs, the attachment ends of the arms will be along the same horizontal plane and the attachment ends of the links will be along a separate horizontal plane. The links are somewhat shorter than the arms. This overall geometry has been determined to provide a sturdy and reliable means for attaching auxiliary equipment to a wheelchair.

Figure 6:
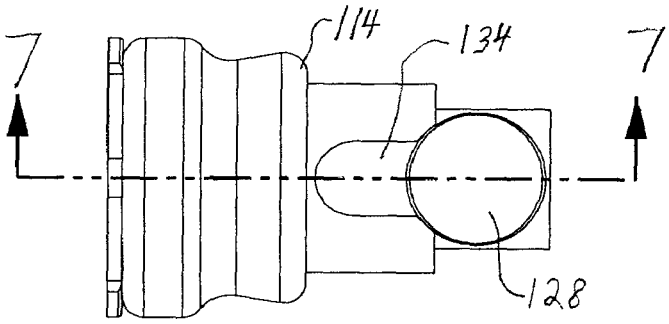
FIGS. 6-9 illustrate operation of a collar for a ball-and-socket joint.
Figure 7:
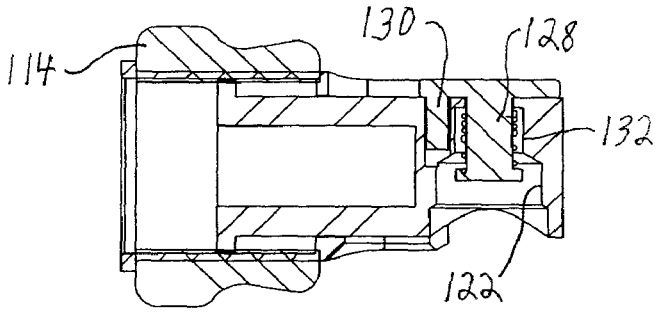

The operation of a collar 112 will be described with reference to FIGS. 6, 7, 8 and 9. FIGS. 6 and 7 show the collar in its retracted position. In this position, the rearward end of the collar 114 abuts a top button portion of a member 128. The member 128 has a general T-shape, but includes a downwardly depending leg 130, as viewed in FIG. 7. A coil spring 132 biases this member 128 into the position of FIGS. 6 and 7. In this condition, the collar abuts the top of the member and is prevented from moving rearwardly (i.e., to the right as viewed in FIGS. 6 and 7).

While not shown in FIGS. 6 and 7, the collar 114 is spring biased to force the collar rearwardly when the T-shaped member 128 permits. As shown in FIG. 6, the collar includes a U channel 134. The channel is dimensioned such that the top of the member 128 will not fit within the channel, but any other region of the member fits within the channel. A corresponding channel resides on the opposite side of the collar 114.

Figure 8:
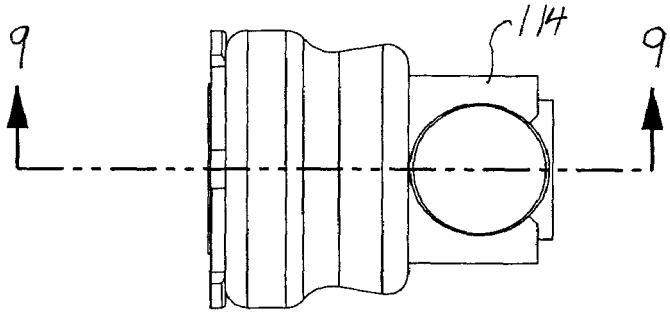
Figure 9:
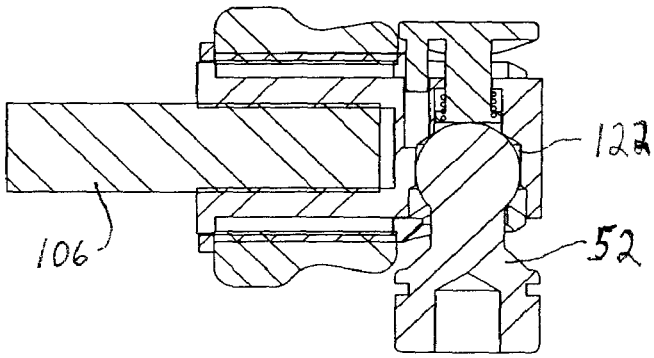

The insertion of a ball stud into the ball socket 122 overcomes the bias of the coil spring 132 and forces the member 128 upwardly. This allows the spring-bias collar to move rearwardly. FIGS. 8 and 9 show the position of the collar 114 after a ball stud 52 has been inserted within the ball socket 122. The top U channel extends rearwardly to receive the lower portion of the T-shaped member 128. The lower U-shape channel of the collar receives a region of the ball stud 52, causing the ball stud to be locked in position. As a consequence, a secure attachment is achieved until a user intentionally releases the ball stud from the ball socket. In the operation of the structure shown in FIGS. 6-9, the collar 114 remains in a position that allows insertion of the ball stud 52. The collar slides to the locked position of FIGS. 8 and 9 only after a ball stud 52 presses the T-shaped member 128 such that its expanded upper position no longer restricts movement of the collar. The spring bias of the collar maintains the collar in a locked position until a person overcomes the bias of the spring and releases the ball stud. Thus, a quick-release mechanism is provided.

Referring now to FIG. 2, the sequence for attaching the hand cycle 10 or other auxiliary equipment to the wheelchair 12 begins with attaching the two arms 78 and 82 to the lower pair of clamps 48 and 50. The ends of the arms are rotated in order to have an orientation to accept the upwardly directed ball studs of the clamps. Then, the user can push against the hand cycle 10 to lift the two front casters 18 and 20. With the two casters raised above the floor level, the two links 86 and 88 are attached to the upper clamps 44 and 46 having the outwardly directed ball studs. This connection process is easily accomplished as a consequence of the maneuverability of the ball-and-socket connections. After the arms and links have been attached to the wheelchair, the user has the option of powering the wheelchair by rotation of the pedals 36.

While FIGS. 6-8 show a particular embodiment for a quick-release mechanism, other mechanisms may be used without diverging from the invention as described herein. Additionally, the mounting assembly has been described with reference to a hand cycle, but other auxiliary equipment may be substituted.

What is claimed is:

1. A mounting assembly for attaching auxiliary equipment to a wheelchair comprising:

a main column having a column axis;

a first arm having a forward end connected to said main column to pivot about an axis that is generally co-axial with said main column;

a second arm having a forward end connected to said main column to pivot about said axis independently of said first arm so as to accommodate attachment of said mounting assembly to a variety of wheelchairs of different widths and configurations, each of said first and second arms having an arm attachment end configured to enable connection to arm mounting hardware at a wide range of possible orientations; and first and second links respectively pivotally connected to said first and second arms at areas between said forward ends and said arm attachment ends, each of said first and second links having a link attachment end configured to enable connection to link mounting hardware at a wide range of possible orientations, each of said arm and link attachment ends being independently manipulable; wherein said first arm and said second arm form two sides of a triangle that is completed by a tubular frame of said wheelchair;

said first link, said first arm and said tubular frame of said wheelchair form a second triangle with said first link and said first arm being at respective secured lengths; and said second link, said second arm and said tubular frame of said wheelchair form a third triangle with said second link and said second arm being at respective secured lengths.

2. The mounting assembly of claim 1 wherein each said arm attachment end and each said link attachment end has a geometry which is cooperative with operatively associated said arm and link mounting hardware to form a ball-and-socket arrangement.

3. The mounting assembly of claim 2 further comprising said arm and link mounting hardware, wherein said arm and link mounting hardware includes a plurality of ball studs and a plurality of clamps shaped to securely clamp to a frame of said wheelchair, each said arm and link attachment end having a mating surface to receive one of said ball studs.

4. The mounting assembly of claim 3 wherein said ball studs have threaded regions which are operable in tightening said clamps to said frame of said wheelchair, each said clamp having first and second portions with first ends connected at a hinge and second ends configured to enable use of one of said ball studs in tightening said clamp.

5. The mounting assembly of claim 1 further comprising a hinge to which said forward ends of said first and second arms are attached, said hinge being positioned to define said axis that is generally co-axial with said main column.

6. The mounting assembly of claim 1 wherein said first and second links and arms are connected to said frame of said wheelchair to permit folding and unfolding of said wheelchair.

7. The mounting assembly of claim 1 wherein said first and second links are adjustable in length.

8. The mounting assembly of claim 1 wherein each of said first and second arms is adjustable in length when said arm attachment end is rotated to vary a location of a threaded region relative to said forward end.

9. The mounting assembly of claim 1 wherein each said first and second link is adjustable in length when said link attachment end is rotated to vary a location of a threaded region.

10. The mounting assembly of claim 1 further comprising an arrangement for adjusting an angle of said main column to the vertical.

11. A wheelchair comprising:

a tubular frame;

a plurality of wheels connected to said tubular frame;

a plurality of ball studs connected to said tubular frame, each said ball stud being a first portion of a ball-and-socket joint; and auxiliary equipment that includes a mounting assembly, said mounting assembly comprising:

(a) a main column and a rotatable wheel powerable by hand or motor, said main column being configured as a steering column through which said rotatable wheel is steered;

(b) first and second arms hinged at said main column and extending from said main column to a pair of said ball studs, each said arm having an arm end which includes surface features that define a ball socket for said ball-and-socket joint, said arm ends being extendable in length and rotatable to enable said ball sockets to couple to said ball studs with a wide range of orientations; and (c) a centering spring having a first end that is fixed relative to said main column and a second end that is connected to apply a bias to one of said arms.

12. The wheelchair of claim 11 wherein said frame includes a plurality of cylindrical frame members, each said ball stud being connected to a clamp having a curved interior surface to follow a contour of one of said frame members.

13. The wheelchair of claim 11 wherein said plurality of ball studs includes at least two said ball studs which are oriented generally vertically and two said ball studs which are oriented generally horizontally.

14. The wheelchair of claim 11 further comprising first and second links extending to a second pair of ball studs, each said link having a rotatable link end which couples to one of said ball studs as a ball socket of said ball-and-socket joint, wherein each said arm end and each said link end is configured for quick release of said ball-and-socket joint, including providing a retractable portion at each said arm and link end.

15. The wheelchair of claim 11 further comprising an alignment mechanism of said main column and said first and second arms, wherein an angle of said main column to the vertical is adjustable by said alignment mechanism.

16. A mounting assembly for attaching auxiliary equipment to a wheelchair comprising:

a main column;

first and second arms having forward ends connected to said main column to pivot about an axis that is generally co-axial, thereby enabling chair-to-chair adjustability with respect to width, said first and second arms being adjustable in length, wherein said main column includes a hinge to which said first and second arms are attached to enable said chair-to-chair adjustability and each said arm includes a first set of alignment holes having a first center-to-center pitch, said hinge having second sets of alignment holes having a second center-to-center pitch different than said first center-to-center pitch to provide a vernier alignment effect in enabling adjustments of an angle of said main column to the vertical;

first and second links having forward ends pivotally connected to said first and second arms, respectively, said first and second links being adjustable in length and securable to said length; and a plurality of clamps configured to be attached to any of a variety of locations on a frame of said wheelchair, each said clamp including a ball stud and each said arm and each said link having a ball socket that is rotatably mounted to accept one of said ball studs directed at a range of different angles to the vertical, with each thusly paired said ball stud and said ball socket providing a quick-release mechanism.

17. The mounting assembly of claim 16 wherein each of the first and second arms includes a portion of an alignment mechanism that provides adjustments of an angle of said main column to the vertical.

18. The mounting assembly of claim 16 wherein:

the auxiliary equipment includes a hand cycle;

the main column supports a steering column of the hand cycle; and front casters of the wheelchair are raised above a floor level by the hand cycle as attached to the wheelchair by the first and second arms, the first and second links, and the plurality of clamps.

19. A mounting assembly for attaching auxiliary equipment to a wheelchair comprising:

a main column having a column axis;

a first arm having a forward end connected to said main column to pivot about an axis that is generally co-axial with said main column;

a second arm having a forward end connected to said main column to pivot about said axis independently of said first arm so as to accommodate attachment of said mounting assembly to a variety of wheelchairs of different widths and configurations, each of said first and second arms having an arm attachment end configured to enable connection to arm mounting hardware at a wide range of possible orientations;

an arrangement for adjusting an angle of said main column to the vertical, said arrangement including providing a first set of alignment holes for each said forward end of said first and second arms and providing a pair of second sets of alignment holes for said main column, wherein a center-to-center pitch of said first sets is different than a center-to-center pitch of said second sets, thereby enabling fine adjustments of said angle by selecting which alignment hole of each said first set is in alignment with which said alignment hole of a corresponding said second set for passage of fastening members; and first and second links respectively connected to said first and second arms, each of said first and second links having a link attachment end configured to enable connection to link mounting hardware at a wide range of possible orientations, each of said arm and link attachment ends being independently manipulable; wherein said first arm and said second arm form two sides of a triangle that is completed by a tubular frame of said wheelchair;

said first link, said first arm and said tubular frame of said wheelchair form a second triangle with said first link and said first arm being at respective secured lengths; and said second link, said second arm and said tubular frame of said wheelchair form a third triangle with said second link and said second arm being at respective secured lengths.

* * * * *